US008919843B2

(12) United States Patent
Gil Vizuete

(10) Patent No.: US 8,919,843 B2
(45) Date of Patent: Dec. 30, 2014

(54) DEVICE FOR REMOVING A PERSON IN A LIFE-THREATENING SITUATION AND METHOD FOR USE

(76) Inventor: Francisco Javier Gil Vizuete, Villanueva del Rey (ES)

( * ) Notice: Subject to any disclaimer, the term of this patent is extended or adjusted under 35 U.S.C. 154(b) by 275 days.

(21) Appl. No.: 12/921,406

(22) PCT Filed: May 22, 2008

(86) PCT No.: PCT/ES2008/000359
§ 371 (c)(1),
(2), (4) Date: Oct. 19, 2010

(87) PCT Pub. No.: WO2009/112599
PCT Pub. Date: Sep. 17, 2009

(65) Prior Publication Data

US 2011/0037285 A1 Feb. 17, 2011

(30) Foreign Application Priority Data

Mar. 11, 2008 (ES) ..... 200800701

(51) Int. Cl.
*A62B 99/00* (2009.01)
*A45F 5/10* (2006.01)
*A61G 7/10* (2006.01)

(52) U.S. Cl.
CPC ..... *A61G 7/1023* (2013.01); *A61G 2200/34* (2013.01); *A61G 2200/52* (2013.01)
USPC ..... 294/140; 294/152; 5/637

(58) Field of Classification Search
USPC ..... 294/140, 152, 142; 5/89.1, 637, 642, 5/646, 648; 602/16, 18; 128/DIG. 23
See application file for complete search history.

(56) References Cited

U.S. PATENT DOCUMENTS

| | | | | | |
|---|---|---|---|---|---|
| 1,510,187 | A | * | 9/1924 | Martin | 128/DIG. 23 |
| 2,523,891 | A | * | 9/1950 | Wallstrom | 5/89.1 |
| 3,008,464 | A | * | 11/1961 | Atkins | 128/DIG. 23 |
| 3,597,774 | A | * | 8/1971 | Warren | 5/84.1 |
| 4,204,529 | A | * | 5/1980 | Cochrane | 602/19 |
| 4,617,691 | A | * | 10/1986 | Monti et al. | 5/643 |
| 4,768,247 | A | * | 9/1988 | Beier | 5/640 |

(Continued)

FOREIGN PATENT DOCUMENTS

| | | |
|---|---|---|
| GB | 2 213 734 | 8/1989 |
| JP | 2004-201890 | 7/2004 |
| RU | 2242952 | 12/2004 |
| WO | 93/21886 | 11/1993 |

OTHER PUBLICATIONS

International Search Report issued Aug. 12, 2008 in International (PCT) Application No. PCT/ES2008/000359.

*Primary Examiner* — Paul T Chin
(74) *Attorney, Agent, or Firm* — Wenderoth, Lind & Ponack, L.L.P.

(57) ABSTRACT

A device for removing a person in a life-threatening situation comprises an elongate, soft, flexible body (1) provided with a central zone (2) that is thicker than two tapered ends (3). A method for removing a person in a life-threatening situation involves passing the central zone (2) around an accident victim's neck, crossing the tapered ends (3) over the nape of the neck and arranging the tapered ends under the armpits, from front to back, so that the tapered ends (3) project behind the accident victim and a rescuer can pull thereon in order to move the accident victim while the latter's neck is immobilized.

12 Claims, 7 Drawing Sheets

(56) References Cited

U.S. PATENT DOCUMENTS

| | | | | | |
|---|---|---|---|---|---|
| 4,991,572 | A * | 2/1991 | Chases | 602/13 |
| 5,022,106 | A * | 6/1991 | Richards | 5/86.1 |
| 5,056,508 | A * | 10/1991 | Brunell | 602/18 |
| 5,644,805 | A * | 7/1997 | Horcher | 5/86.1 |
| 5,685,033 | A * | 11/1997 | Lavin | 5/89.1 |
| 6,088,854 | A * | 7/2000 | Brownrigg | 5/632 |
| 6,175,973 | B1 * | 1/2001 | Hakamiun et al. | 5/89.1 |
| 6,276,006 | B1 | 8/2001 | Hoit | |
| 6,581,222 | B1 * | 6/2003 | Liljedahl | 5/89.1 |
| 6,625,829 | B2 * | 9/2003 | Zell | 5/637 |
| 6,671,899 | B1 * | 1/2004 | Oja | 5/89.1 |
| 7,185,378 | B2 * | 3/2007 | Smith | 5/642 |

* cited by examiner

DEVICE FOR REMOVING A PERSON IN A LIFE-THREATENING SITUATION AND METHOD FOR USE

The present application is the U.S. National Stage of International Application PCT/ES2008/000359, filed May 22, 2008, which claims foreign priority to Spanish Application P200800701, filed Mar. 11, 2008.

OBJECT OF THE INVENTION

The present invention, as stated in the title of this specification, relates to a device for removing a person (i.e., an accident victim) in a life-threatening situation and method for use. The essential purpose of the present invention is to provide a device and a method that allows moving accident victims with the aim of achieving a maximum immobilisation safely and not aggravate the injuries already suffered by the accident victim. The victim can be removed for example from the interior of a vehicle to a zone in which the person can be suitably attended in such a manner that throughout the cover, the neck of the accident victim remains immobilised to avoid possible injuries. The device and the method also provide more comfort to the rescuer that highly reduces the risk for the rescue of being injured during the rescue operation.

BACKGROUND OF THE INVENTION

Since the Spanish health system established the health and medical procedures to adopt in any kind of accidents, various rescue methods are being used which infringe the basic rights relating to physical integrity and risks of infection among the rescuers giving assistance.

When a road traffic accident occurs, and depending on the circumstances of the accident and the urgent or the emergency situation of the accident victims, the way of acting in the corresponding rescues must be such as to minimise the risks and dangers both to the accident victim and the rescuer. When a person is involved in a road traffic accident there may be risks such as the vehicle in which the accident victim is present may begin to catch fire or fall down a ravine, or other circumstances which make difficult to control the situation, so that in order to rescue the accident victims a method called the "Reutex manoeuvre" is known and is being used.

Said Reutex manoeuvre is entirely manual, involving full contact between the rescuer and the accident victim which cause inconveniences such as the possibility of infections.

The application of the Reutex manoeuvre comprises the following:

The patient is inside the vehicle, and the first thing that must be done is to free his/her feet so that they do not become trapped between the pedals of the vehicle. Next, the rescuer takes with his right arm the left arm of the patient. Said arm of the rescuer is passed below the right armpit of the patient and the rescuer grabs the wrist of the victim tightly with his right hand. Then the rescuer passes his left arm below the left armpit of the victim, holding firmly the chin of the victim. The rescuer places the chin of the victim next to his own face to maintain direct contact with the victim, without protection from blood, perspiration and the breath of the victim in order to ensure as much as possible a cervical control. Then the rescuer carries on his shoulders the weight of the victim and lifts the victim and when the victim is removed from the seat of the vehicle, the victim can be pulled and removed from the vehicle to a safe distance.

This conventional method of rescuing accident victims has disadvantages relating to insufficient cervical immobilisation of the accident victim, considerable discomfort to the rescuer and the risk of infection from diseases.

It is not known from the state of the art any device or a corresponding method for rescuing people in life-threatening situations such as the device and method provided by the present invention.

DESCRIPTION OF THE INVENTION

In order to achieve the objectives and avoid the inconveniences indicated in previous sections, the invention comprises a device for removing people in life-threatening situations and a method for its use enabling a rescuer to support and remove an accident victim.

According to the invention, the device of the same comprises, in a novel manner, an elongate, soft, flexible body provided with a central zone that is thicker than two tapered ends.

According to a preferred embodiment of the invention the body of the device referred to consists of a highly resistant and adaptable rubber foam base covered entirely with a highly deformable plastic cover.

On the other hand, the aforementioned tapered ends of the device may be provided with handles to facilitate gripping.

The device described has in its preferred design a length of 2.7 m and a central thickness of 30 cm.

The method for using the device described involves a rescuer supporting and removing an accident victim from the interior of a vehicle or other location, taking him or her to a zone in which he or she can be suitably attended to.

Innovatively, in the method provided by the invention, by means of an elongate, soft and flexible body provided with a central zone that is thicker than two tapered ends, the rescuer proceed as follows:

a) The rescuer checks if the feet of the accident victim are released from the pedals of the vehicle or from other hooking or coupling devices.

b) The rescuer passes the central zone of the body of the device around the neck of the accident victim so that said body is disposed primarily in the frontal region of the neck, and the two tapered ends are then crossed over the nape of the neck of the victim bringing the two ends to the chest of the victim.

c) The rescuer passes those two tapered ends from front to back, under both armpits of the victim, so that the two tapered ends project behind the accident victim, whilst the central zone of the elongate body of the device surrounds and immobilises the neck of the victim.

d) The rescuer pulls on those tapered ends projecting behind the accident victim so that the accident victim can be moved to the zone in which he or she can be attended, so that during the corresponding procedure, the most part of the weight of the victim rests on his/her armpits, whilst at the same time his/her neck is immobilised. In this operation, strangulation of the patient is prevented since friction is generated in the zone of intersection between the device and the occipital region of the patient, so that the entire weight of the patient rests upon his or her armpits.

With the structure of the device that has been described and the steps of the corresponding method, the invention presents the advantages of facilitating rescuing the accident victim without any contact between the rescuer and the body of the victim, making it much more difficult to be infected by diseases. Moreover, the device and its correct use guarantee almost complete immobilisation of the neck of the accident victim. On the other hand, the victim or accident victim can be removed without a big effort to a safe zone by pulling on the ends of the device. Other advantages of the device of the invention are the fact that it occupies little space, it is easy to clean and its use is very simple. Moreover, the embodiment of the device which includes a plastic cover facilitates its washing if it is stained with blood or other type of contamination.

To allow a clearer understanding of this description, and forming an integral part of the same, figures are provided below which represent by way of illustration, but not exhaustively, the object of the invention.

DESCRIPTION OF A PREFERRED EMBODIMENT

A description of an embodiment of the invention is provided herebelow making reference to the numbering adopted in the figures.

Figure 1:
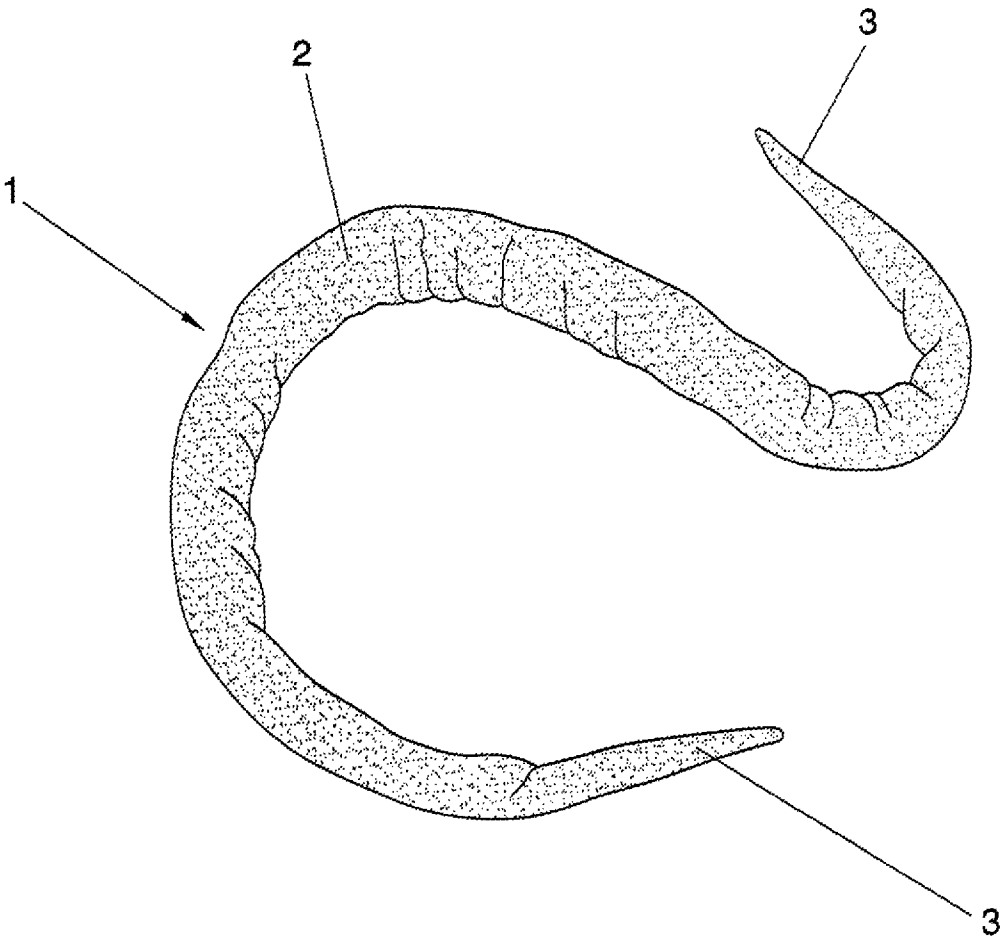
FIG. 1 shows a perspective view of a device for removing people in a life-threatening situation, according to a preferred embodiment of the present invention.

In a preferred embodiment of the invention, the device provided comprises an elongate, soft and flexible body 1 which is provided with a central zone 2 that is thicker than two tapered ends 3, as shown in FIG. 1.

In the present embodiment of the invention, body 1 consists of a highly resistant and adaptable rubber foam base which is covered entirely with a highly deformable plastic cover.

Figure 7:
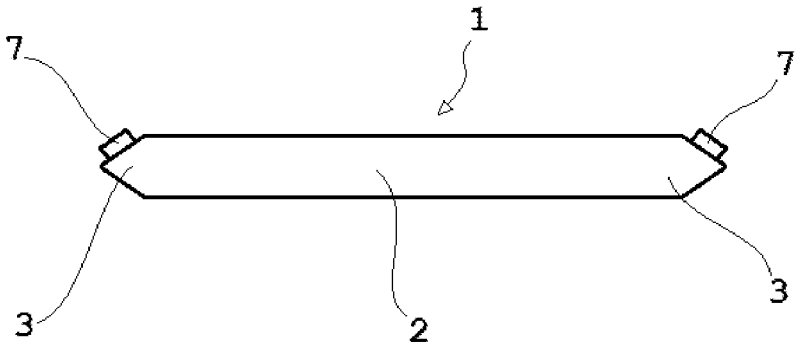
FIG. 7 shows a schematic view of a device for removing people in a life-threatening situation, according to another embodiment of the present invention.

In other embodiments, handles 7 could be provided on tapered ends 3 to facilitate gripping, as shown in FIG. 7.

In the embodiment shown in this embodiment of the invention, body 1 has a length of 2.7 m and a central thickness of 30 cm.

The method for use of the device shown in FIG. 1 is represented in FIGS. 2 to 6. A rescuer 5 supports and removes an accident victim 4 from the interior of a vehicle 6, or from another location, moving the accident victim to a zone in which he or she can be suitably attended.

In the method shown in this embodiment of the invention, the device provided by the invention is used in the following manner:

First it is checked if the feet of accident victim 4 are released from the pedals of vehicle 6 or from other hooking or coupling devices.

Figure 2:
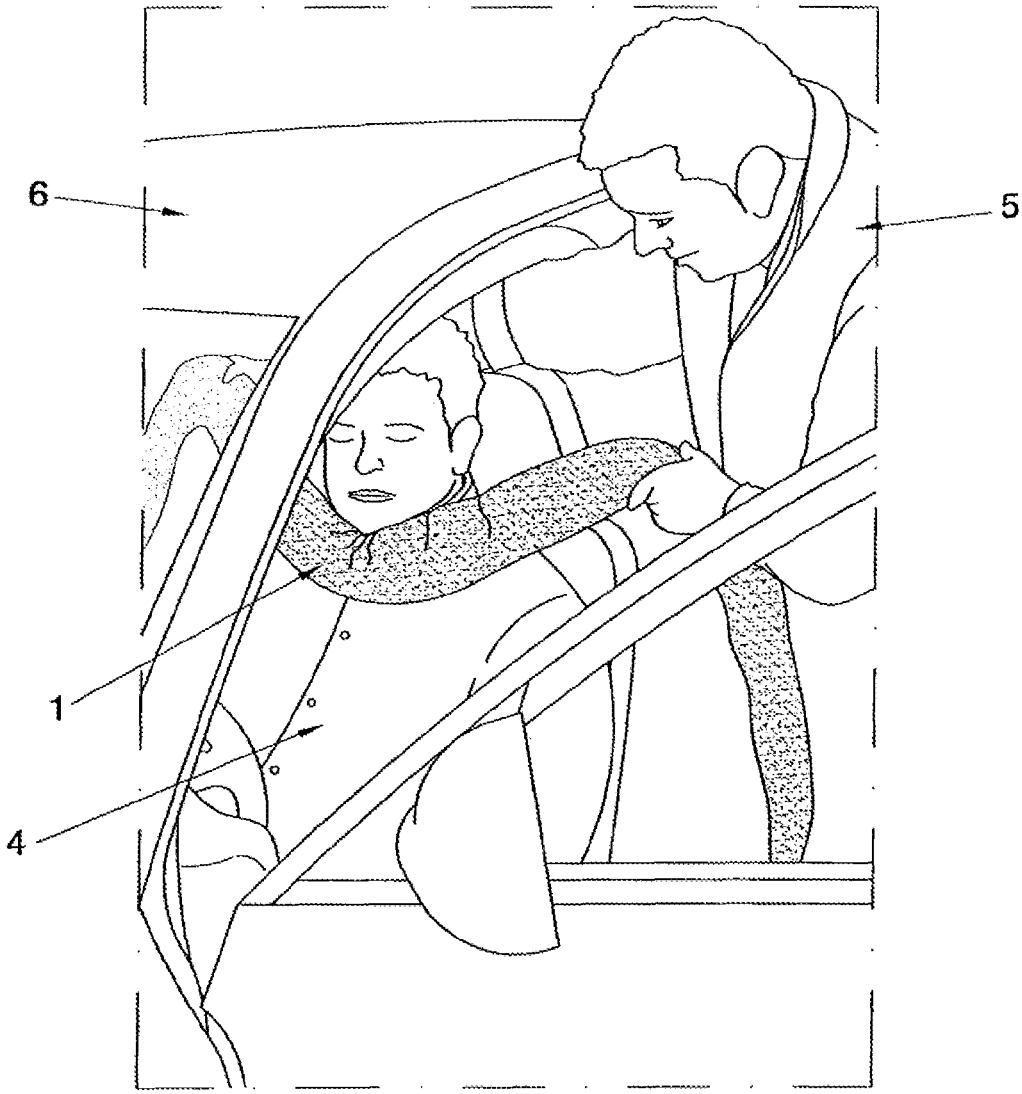
FIGS. 2 to 6 show schematically different steps in the application of a method for use of the device shown in FIG. 1 above, showing how an accident victim is rescued from a vehicle using said device.
Figure 3:
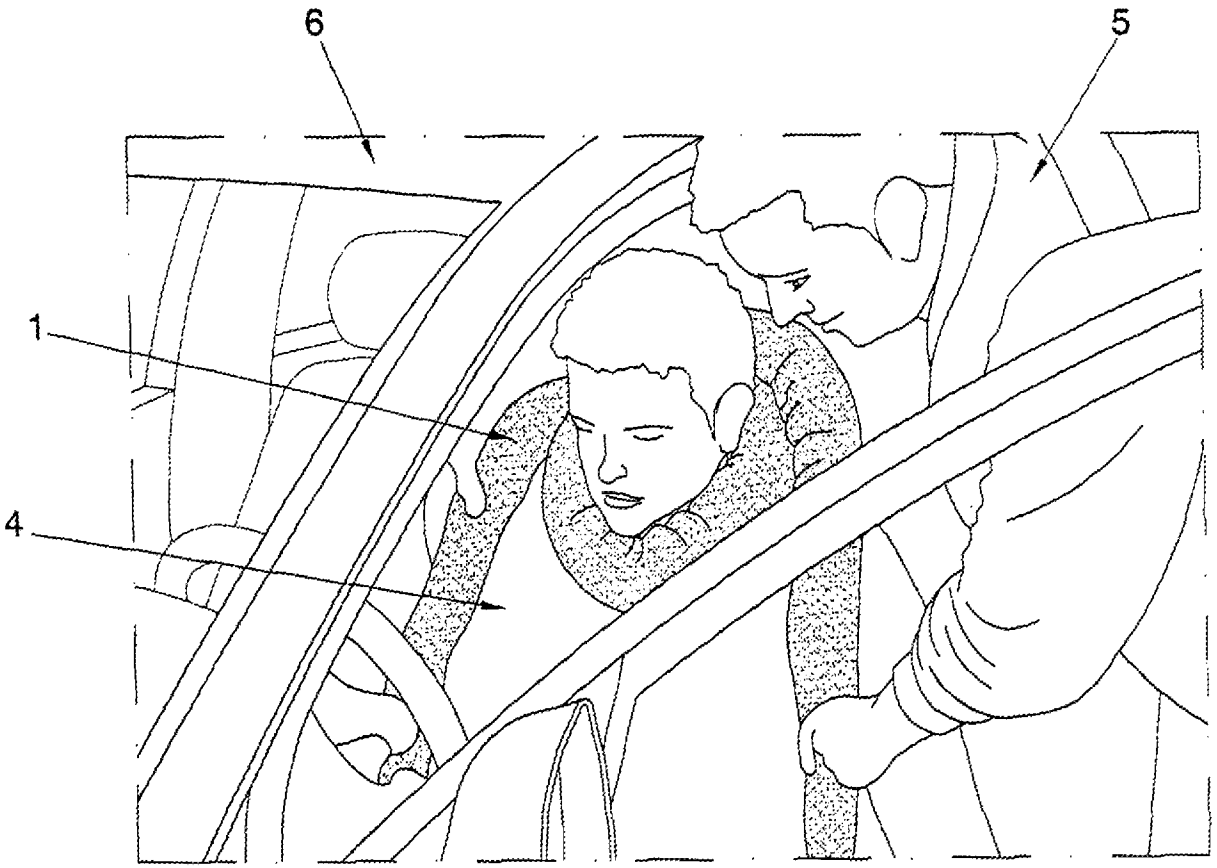

Central zone 2 of body 1 of the device is passed around the neck of the victim 4 so that said body 1 is disposed primarily in the frontal region of the neck, as shown in FIG. 2, and the two tapered ends 3 are then crossed over the nape of the neck of victim 4 bringing the two ends 3 to the chest of victim 4, as can be seen in FIG. 3.

Figure 4:
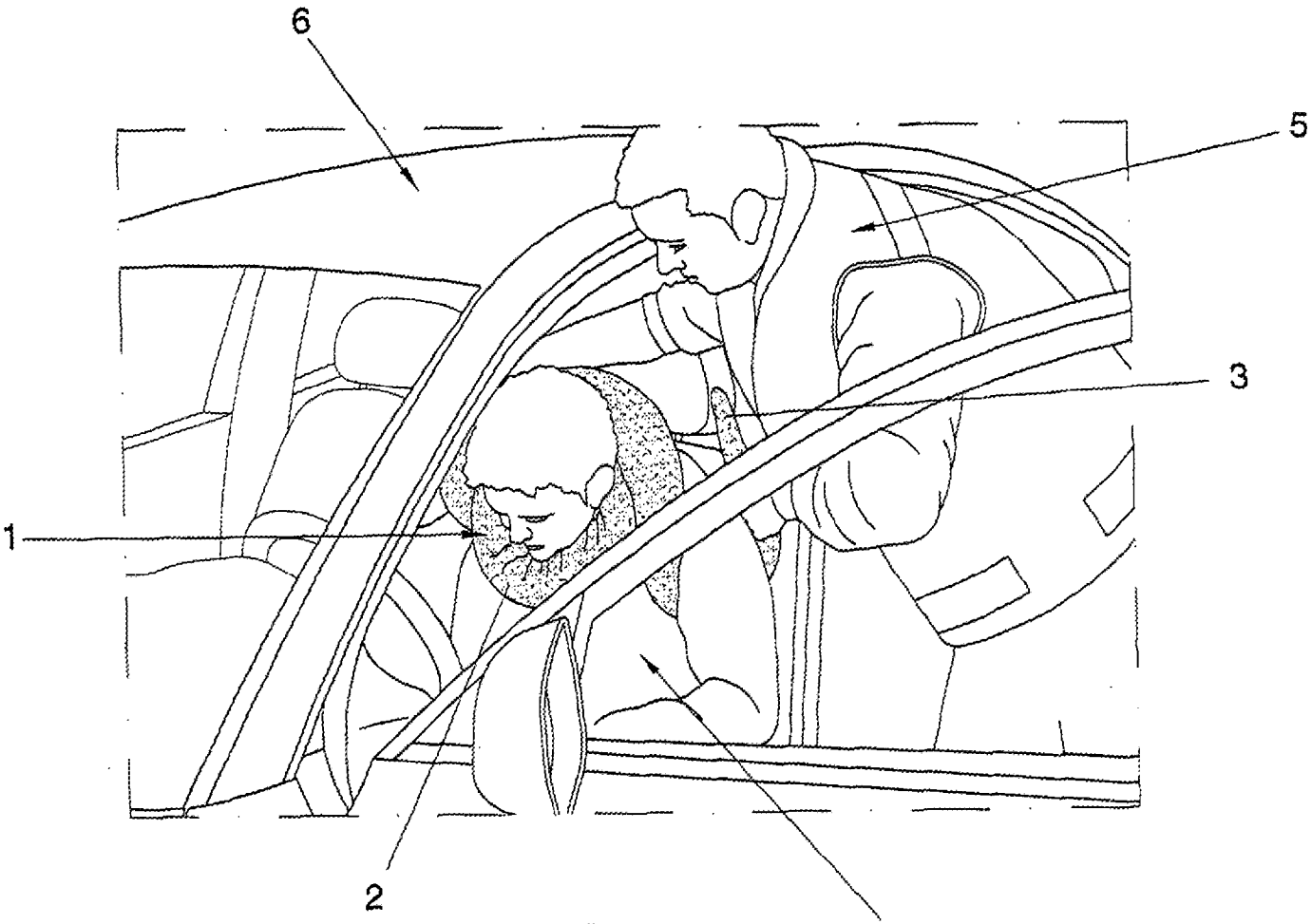

Those two tapered ends 3 are then passed respectively from front to back under the two armpits of victim 4 so that the two tapered ends 3 project behind victim 4 whilst central zone 2 of elongate body 1 of the device surrounds and immobilises the neck of victim 4, as can be seen in FIG. 4.

Figure 5:
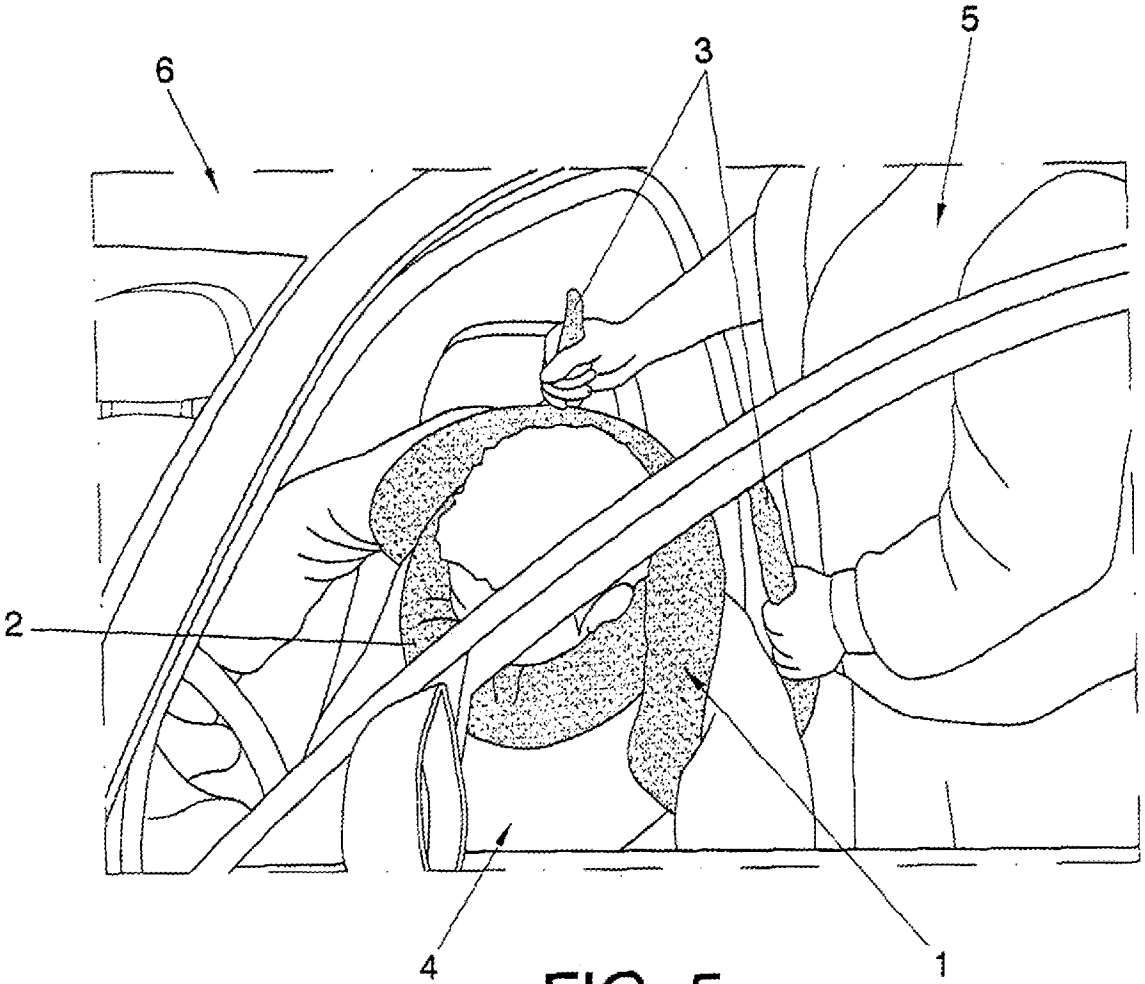
Figure 6:
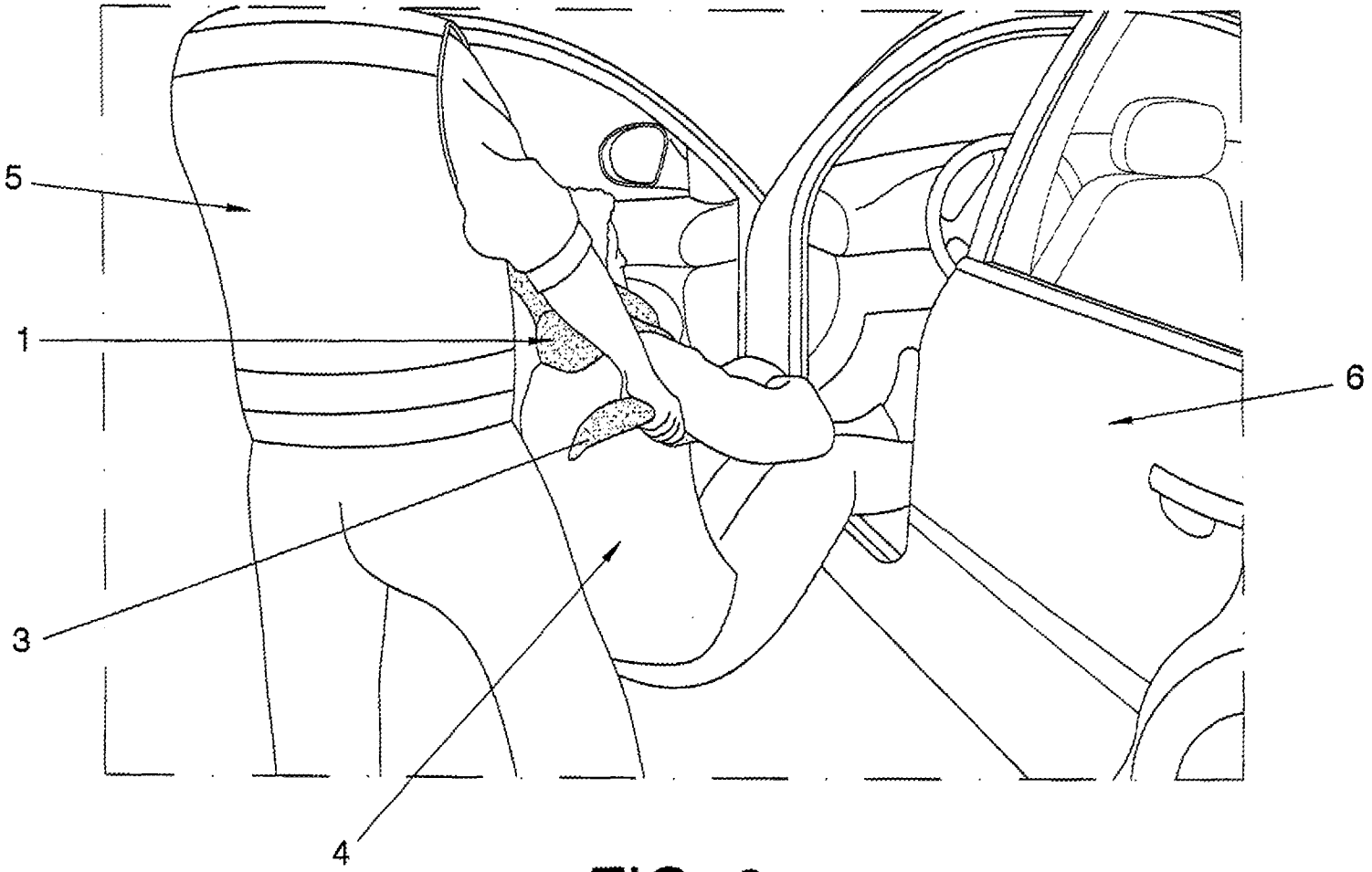

Those tapered ends 3 projecting behind victim 4 will then be pulled on until the victim is moved to a zone in which he or she can be suitably attended, so that in the corresponding procedure the most part of the weight of victim 4 rests ton his or her armpits, at the same as his or her neck remains immobilised, as illustrated in FIGS. 5 and 6. In this operation strangulation of the patient is prevented by the friction which is generated in the zone of intersection between the device and the occipital region of the patient, so that the most part of the weight of the patient rests on his or her armpits, as explained.

The invention claimed is:

1. A device for removing an accident victim in a life-threatening situation, enabling a rescuer (5) to support and remove the victim (4), comprising an elongate, soft, flexible body (1) having a central zone (2) and two tapered ends (3);

wherein the central zone (2) is thicker than the two tapered ends (3);

wherein the elongate, soft, flexible body (1) consists of a highly resistant and adaptable rubber foam base, and a highly deformable plastic cover which entirely covers said highly resistant and adaptable rubber foam base, said highly deformable plastic cover covering only said highly resistant and adaptable rubber foam base; and wherein the highly deformable plastic cover is unitary and tube-shaped, and has a length such that a neck of the victim is completely surrounded and substantially immobilized and the two tapered ends extend under respective armpits of the victim, during a removal of the victim; and, wherein the central zone (2) of the elongate, soft, flexible body (1) has a width such that the central zone (2) is fitted between a chin and an upper chest region of the victim, and the neck of the victim is substantially immobilized during the removal of the victim.

2. A device for removing an accident victim in a life-threatening situation, according to claim 1, wherein said tapered ends (3) are provided with handles to facilitate gripping.

3. A device for removing an accident victim in a life-threatening situation, according to claim 2, wherein said body has a length of 2.7 m and a central thickness of 30 cm.

4. A method for removing an accident victim in a life-threatening situation, to enable a rescuer (5) to support and remove the accident victim (4) from the interior of a vehicle (6) or other location, and moving the accident victim (4) to a zone in which the accident victim (4) can be suitably attended, the method comprising:

obtaining the structural limitations of claim 3;

checking to ensure that the feet of the accident victim (4) are released from pedals of the vehicle (6) and from other hooking or coupling devices;

passing the central zone (2) of the body (1) of the device around the neck of the accident victim (4) so that said body (1) is disposed primarily in the frontal region of the neck, and the two tapered ends (3) are then crossed over the nape of the neck of the accident victim (4) bringing the two ends (3) to the chest of the accident victim (4);

passing the two tapered ends (3), respectively, from front to back, under both armpits of the accident victim (4), so that the two tapered ends (3) project behind the accident victim (4), whilst the central zone (2) of the device surrounds and immobilizes the neck of the accident victim (4);

pulling on the tapered ends (3) which project behind the accident victim (4) until the accident victim is taken to a zone in which the accident victim (4) can be attended, so that in the corresponding procedure most of the weight of the accident victim (4) rests on the armpits of the rescuer (5), at the same time that the neck of the accident victim (4) remains immobilized.

5. A method for removing an accident victim in a life-threatening situation, according to claim 4, wherein the checking to ensure that the feet of the accident victim (4) are released from pedals of the vehicle (6) and from other hooking or coupling devices, the passing of the central zone (2) of the body (1) of the device around the neck of the accident victim (4), the passing of the two tapered ends (3), respectively, from front to back, under both armpits of the accident victim (4), and the pulling on the tapered ends (3) which project behind the accident victim (4), are all performed by the rescuer (5).

6. A method for removing an accident victim in a life-threatening situation, to enable a rescuer (5) to support and remove the accident victim (4) from the interior of a vehicle (6) or other location, and moving the accident victim (4) to a zone in which the accident victim (4) can be suitably attended, the method comprising:

obtaining the structural limitations of claim 2;

checking to ensure that the feet of the accident victim (4) are released from pedals of the vehicle (6) and from other hooking or coupling devices;

passing the central zone (2) of the body (1) of the device around the neck of the accident victim (4) so that said body (1) is disposed primarily in the frontal region of the neck, and the two tapered ends (3) are then crossed over the nape of the neck of the accident victim (4) bringing the two ends (3) to the chest of the accident victim (4);

passing the two tapered ends (3), respectively, from front to back, under both armpits of the accident victim (4), so that the two tapered ends (3) project behind the accident victim (4), whilst the central zone (2) of the device surrounds and immobilizes the neck of the accident victim (4);

pulling on the tapered ends (3) which project behind the accident victim (4) until the accident victim is taken to a zone in which the accident victim (4) can be attended, so that in the corresponding procedure most of the weight of the accident victim (4) rests on the armpits of the rescuer (5), at the same time that the neck of the accident victim (4) remains immobilized.

7. A method for removing an accident victim in a life-threatening situation, according to claim 6, wherein the checking to ensure that the feet of the accident victim (4) are released from pedals of the vehicle (6) and from other hooking or coupling devices, the passing of the central zone (2) of the body (1) of the device around the neck of the accident victim (4), the passing of the two tapered ends (3), respectively, from front to back, under both armpits of the accident victim (4), and the pulling on the tapered ends (3) which project behind the accident victim (4), are all performed by the rescuer (5).

8. A device for removing an accident victim in a life-threatening situation, according to claim 1, wherein said body has a length of 2.7 m and a central thickness of 30 cm.

9. A method for removing an accident victim in a life-threatening situation, to enable a rescuer (5) to support and remove the accident victim (4) from the interior of a vehicle (6) or other location, and moving the accident victim (4) to a zone in which the accident victim (4) can be suitably attended, the method comprising:

obtaining the structural limitations of claim 8;

checking to ensure that the feet of the accident victim (4) are released from pedals of the vehicle (6) and from other hooking or coupling devices;

passing the central zone (2) of the body (1) of the device around the neck of the accident victim (4) so that said body (1) is disposed primarily in the frontal region of the neck, and the two tapered ends (3) are then crossed over the nape of the neck of the accident victim (4) bringing the two ends (3) to the chest of the accident victim (4);

passing the two tapered ends (3), respectively, from front to back, under both armpits of the accident victim (4), so that the two tapered ends (3) project behind the accident victim (4), whilst the central zone (2) of the device surrounds and immobilizes the neck of the accident victim (4);

pulling on the tapered ends (3) which project behind the accident victim (4) until the accident victim is taken to a zone in which the accident victim (4) can be attended, so that in the corresponding procedure most of the weight of the accident victim (4) rests on the armpits of the rescuer (5), at the same time that the neck of the accident victim (4) remains immobilized.

10. A method for removing an accident victim in a life-threatening situation, according to claim 9, wherein the checking to ensure that the feet of the accident victim (4) are released from pedals of the vehicle (6) and from other hooking or coupling devices, the passing of the central zone (2) of the body (1) of the device around the neck of the accident victim (4), the passing of the two tapered ends (3), respectively, from front to back, under both armpits of the accident victim (4), and the pulling on the tapered ends (3) which project behind the accident victim (4), are all performed by the rescuer (5).

11. A method for removing an accident victim in a life-threatening situation, to enable a rescuer (5) to support and remove the accident victim (4) from the interior of a vehicle (6) or other location, and moving the accident victim (4) to a zone in which the accident victim (4) can be suitably attended, the method comprising:

obtaining the structural limitations of claim 1;

checking to ensure that the feet of the accident victim (4) are released from pedals of the vehicle (6) and from other hooking or coupling devices;

passing the central zone (2) of the body (1) of the device around the neck of the accident victim (4) so that said body (1) is disposed primarily in the frontal region of the neck, and the two tapered ends (3) are then crossed over the nape of the neck of the accident victim (4) bringing the two ends (3) to the chest of the accident victim (4);

passing the two tapered ends (3), respectively, from front to back, under both armpits of the accident victim (4), so that the two tapered ends (3) project behind the accident victim (4), whilst the central zone (2) of the device surrounds and immobilizes the neck of the accident victim (4);

pulling on the tapered ends (3) which project behind the accident victim (4) until the accident victim is taken to a zone in which the accident victim (4) can be attended, so that in the corresponding procedure most of the weight of the accident victim (4) rests on the armpits of the rescuer (5), at the same time that the neck of the accident victim (4) remains immobilized.

12. A method for removing an accident victim in a life-threatening situation, according to claim 11, wherein the checking to ensure that the feet of the accident victim (4) are released from pedals of the vehicle (6) and from other hooking or coupling devices, the passing of the central zone (2) of the body (1) of the device around the neck of the accident victim (4), the passing of the two tapered ends (3), respectively, from front to back, under both armpits of the accident victim (4), and the pulling on the tapered ends (3) which project behind the accident victim (4), are all performed by the rescuer (5).

* * * * *